United States Patent [19]

Goff et al.

[11] 4,258,908

[45] Mar. 31, 1981

[54] CHELA-FORM CLAMP

[75] Inventors: Melvin J. Goff; Gerald W. Goff, both of Kalamazoo, Mich.

[73] Assignee: Continental Pump, Inc., Portage, Mich.

[21] Appl. No.: 40,240

[22] Filed: May 17, 1979

[51] Int. Cl.[3] ..... B25B 1/12

[52] U.S. Cl. ..... 269/239; 269/249; 269/285

[58] Field of Search ..... 269/237–240, 269/285, 246–253; 254/67; 308/156, 158

[56] References Cited

U.S. PATENT DOCUMENTS 2,530,130 11/1950 Parker ..... 269/238

2,726,694 12/1955 Saxton ..... 269/237

FOREIGN PATENT DOCUMENTS 232414 8/1944 Switzerland ..... 269/285

755680 8/1956 United Kingdom ..... 269/252

*Primary Examiner*—Robert C. Watson

*Attorney, Agent, or Firm*—Gordon W. Hueschen

[57] ABSTRACT

A chela-form clamp in which clamping action is effected by the thrust of an elongate member on a thrust block journaled in one leg of the clamp characterized by conical surfaces between the thrust block and the thrust end of the elongate member and a steel ball between them having circle contact with the conical surfaces.

1 Claim, 3 Drawing Figures

CHELA-FORM CLAMP

FIELD OF THE INVENTION AND PRIOR ART

The invention relates to improvements in a chela-form clamp, particularly of the kind which comprises an L-shaped member having a short leg and a long leg joined by a knee, a second L-shaped member having a short leg and a leg of intermediate length also joined by a knee, in which the leg of intermediate length is journaled in the mid-portion of the long leg, and in which the L-shaped legs comprise spaced-apart complementary members joined together by spacers, apposed clamping faces at the ends of the short legs, a first block journaled in the complementary members at the knee of the second L-shaped leg, a second block journaled in the complementary members at the end of the long leg, an elongate member passing through the second block and having a thrust connection with the first block, and thread means operative when the elongate member is turned to exert thrust on the first block and to force the first and second blocks apart, in order to bring the clamping faces closer together or to exert pressure on the clamping faces when they are already as close together as possible.

Clamps of the character described are known in the art. In one, the thread means is of the quick-release type whereby the elongate member can be rapidly moved to set the clamping faces in clamping position and then turned to generate the thrust necessary to effect the desired clamping operation. In the devices heretofore available, considerable difficulty has been encountered in obtaining the desired pressure on the clamping faces because the angle of thrust is such that an excessive degree of friction is engendered between the thrust end of the elongate member and the thrust block.

OBJECTS OF THE INVENTION

It is an object of the invention to provide an improved chela-form clamp. It is a further object of the invention to provide an improved chela-form clamp in which relatively high pressures can be applied to the clamping faces without engendering excessive friction in the elongate member. It is a further object of the invention to avoid the disadvantages of the prior art and to obtain the advantages as will appear as the description proceeds.

BRIEF DESCRIPTION OF THE INVENTION

The invention relates to improvements in a chela-form clamp of the class above-described, characterized by a radial bore in the first block adapted to receive the thrust end of the elongate member, by the radial bore having a conical bottom, by a steel ball in the bore having circle contact with the conical bottom thereof, by the thrust end of the elongate member having an axial conical depression therein having circle contact with the ball, and by means for rotatably anchoring the thrust end in the axial bore.

DETAILED DESCRIPTION OF THE INVENTION

Figure 1:
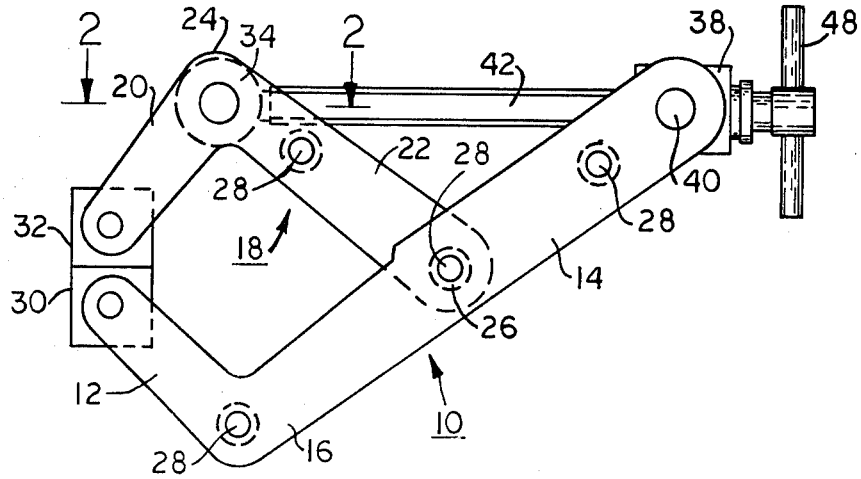
FIG. 1 is a side elevation.

In FIG. 1 there is shown a chela-form clamp having L-shaped member 10 having a short leg 12 and a long leg 14 joined by a knee 16, a second L-shaped member 18, having a short leg 20 and a leg of intermediate length 22 and a knee 24. The leg of intermediate length 22 is journaled at 26 near the middle of the long leg 14.

Figure 3:
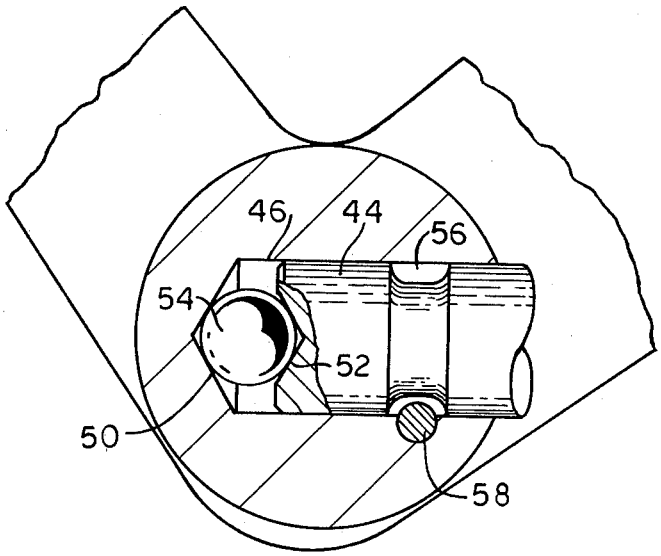
FIG. 3 is a section taken along lines 3—3 of FIG. 2.
Figure 2:
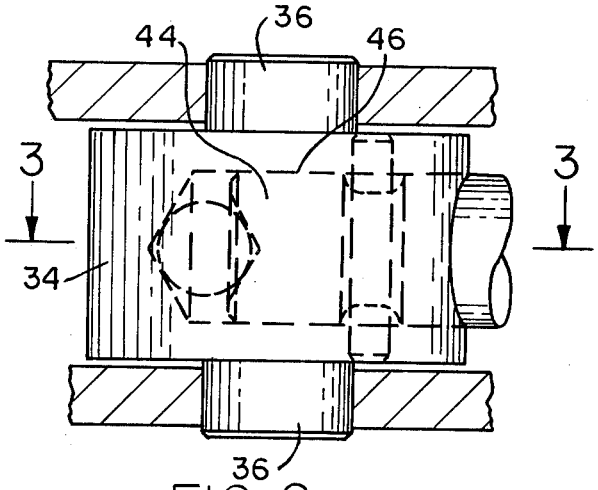
FIG. 2 is a section taken along lines 2—2 of FIG. 1.

Each of the L-shaped members is made of two spaced-apart complementary pieces fastened together by spacers 28. At the end of the short legs 12 and 20 are journaled blocks 30 and 32 which also serve as spacers for the complementary members and as clamping faces Journaled between the complementary members at the knee 24 is a block 34 which is generally cylindrical in shape and has axial trunnions 36 journaled in the complementary members of the knee 24, as shown in in FIG. 2. Also, at the end of the long leg is a second block 38 jounaled there by trunnions 40.

Passing through the second block 38 is an elongate member 42 having a thrust end 44 disposed in an axial bore 46 in the first block 34. A quick-release thread is provided in the block 38 so that, when the handle 48 is turned clockwise, a thrust is exerted on block 34 and blocks 34 and 38 are spread apart and clamping faces 30 and 32 are brought into clamping position.

The bottom of the bore 46 is conical in shape, as shown at 50, and the thrust end 44 of elongate member 42 has a complementary conical depression 52. A steel ball 54 is seated in the bottom of the bore 46 and has circle contact with the conical bottom 50 of the bore and circle contact with the conical depression 52 in the thrust end 44 of the elongate member 42. Thus, when a thrust is put on the elongate member 42, the circle-circle contact on the steel ball 54 relieves the friction so that a great deal of pressure can be put on the clamping faces 30 and 32.

The thrust end 44 has a circumferential groove 56 to accomodate the key 58 to rotatably hold the thrust end 44 of the elongate member 42 and the bore 46.

The conical surfaces at 50 and 52 can, if desired, be case hardened or otherwise hardened to enhance the anti-friction effect.

It is to be understood that the invention is not to be limited to the exact details of operation or structure shown and described, as obvious modifications and equivalents will be apparent to one skilled in the art.

We claim:

1. In a Chela-form clamp comprising an L-shaped member having a short leg and a long leg joined by a knee, a second L-shaped member having a short leg and a leg of intermediate length joined by a knee, said leg of intermediate length being journaled in the mid-portion of said long leg, and said L-shaped legs comprising spaced-apart complementary members joined together by spacers, apposed clamping faces at the ends of said short legs, a first block journaled in the complementary members at the knee of said second L-shaped leg, a second block journaled in the complementary members at the end of said long leg, an elongate member passing through said second block and having thrust contact with said first block, thread means operative when said member is turned to place thrust on said first block and to force the first and second blocks apart, the combination in which said first block has a radial bore having a conical bottom adapted to receive the thrust end of said elongate member located well past the journal axis, a steel ball disposed in said bore which has circle contact with the conical bottom of said bore, the thrust end of said elongate member has an axial conical depression therein having circle contact with said ball, and said thrust end is rotatably anchored in said axial bore by means located in front of the journal axis, in which said elongate member has a cylindrical portion closely fitting said bore and rotatable therein, in which the circle of contact between said steel ball and the conical bottom of said bore is parallel with the circle of contact between said ball and the conical depression at the thrust end of said elongate member, and in which the parallel circles of contact are past the journal axis.

* * * * *

UNITED STATES PATENT AND TRADEMARK OFFICE

CERTIFICATE OF CORRECTION

PATENT NO. : 4,258,908

DATED : March 31, 1981

INVENTOR(S) : Melvin J. Goff and Gerald W. Goff

It is certified that error appears in the above-identified patent and that said Letters Patent are hereby corrected as shown below:

Col. 2, line 14; insert period "." after "faces"
Col. 2, line 18; "shown in in" delete "in", first occurrence.
Col. 2, line 20; "jounaled" should read -- journaled --
Col. 3, line 1; "said member" should read -- said elongate member --
Response and Amendment dated June 23, 1980, page 2, claim 1, line 16.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*